US007621316B2

(12) United States Patent
Kawabata et al.

(10) Patent No.: US 7,621,316 B2
(45) Date of Patent: Nov. 24, 2009

(54) HEAT SINK WITH HEAT PIPES AND METHOD FOR MANUFACTURING THE SAME

(75) Inventors: Kenya Kawabata, Tokyo (JP); Masaru Oomi, Tokyo (JP); Ryoji Ohno, Tokyo (JP)

(73) Assignee: The Furukawa Electric Co., Ltd. (JP)

( * ) Notice: Subject to any disclaimer, the term of this patent is extended or adjusted under 35 U.S.C. 154(b) by 0 days.

(21) Appl. No.: 11/702,333

(22) Filed: Feb. 5, 2007

(65) Prior Publication Data

US 2007/0131387 A1 Jun. 14, 2007

Related U.S. Application Data

(63) Continuation of application No. 10/936,850, filed on Sep. 9, 2004.

(60) Provisional application No. 60/502,821, filed on Sep. 12, 2003.

(51) Int. Cl.
*F28D 15/00* (2006.01)
*H05K 7/20* (2006.01)

(52) U.S. Cl. ..... 165/80.3; 165/104.21

(58) Field of Classification Search ..... 165/80.3, 165/104.21, 104.33, 168, 170; 361/700, 361/704; 257/715
See application file for complete search history.

(56) References Cited

U.S. PATENT DOCUMENTS 4,353,415 A 10/1982 Klaschka et al.
4,880,052 A * 11/1989 Meyer et al. ..... 165/104.14
4,960,170 A 10/1990 Carter
5,283,715 A 2/1994 Carlsten et al.
5,409,055 A 4/1995 Tanaka et al.
5,880,524 A * 3/1999 Xie ..... 257/704
6,102,110 A * 8/2000 Julien et al. ..... 165/104.33
6,133,631 A 10/2000 Belady
6,148,906 A * 11/2000 Li et al. ..... 165/104.33

(Continued)

FOREIGN PATENT DOCUMENTS

JP 52-10776 7/1975

(Continued)

OTHER PUBLICATIONS

Office Action Notice of Reason for Rejection for Patent Application No. 2004-262592; Mailing date Aug. 26, 2008; with English translation.

(Continued)

*Primary Examiner*—Tho v Duong
(74) *Attorney, Agent, or Firm*—Cantor Colburn LLP

(57) ABSTRACT

A heat sink to be used with a heat source can include a base portion and a fin portion. The base portion can include a plurality of heat pipes and a space formed at least partially between adjacent heat pipes. The base portion can also include a first plate thermally connected to the heat source and a second plate thermally connected to the fin portion. The plurality of heat pipes contacts the first plate and the second plate. The plurality of heat pipes can also include a first portion that is closer than a second portion to the heat source. Additionally, a distance between adjacent heat pipes is smaller at the first portion than at the second portion.

6 Claims, 9 Drawing Sheets

U.S. PATENT DOCUMENTS

| | | | | |
|---|---|---|---|---|
| 6,191,946 | B1 * | 2/2001 | Yu et al. | 361/704 |
| 6,343,643 | B1 * | 2/2002 | Bollesen | 165/80.3 |
| 6,666,260 | B2 | 12/2003 | Tantoush | |
| 6,679,317 | B2 | 1/2004 | Kokubo et al. | |
| 6,766,817 | B2 | 7/2004 | da Silva | |
| 6,779,595 | B1 | 8/2004 | Chiang | |
| 6,918,404 | B2 | 7/2005 | Dias da Silva | |
| 7,066,586 | B2 | 6/2006 | da Silva | |
| 7,285,255 | B2 | 10/2007 | Kadlec et al. | |
| 2004/0035558 | A1 * | 2/2004 | Todd et al. | 165/104.26 |

FOREIGN PATENT DOCUMENTS

| | | | |
|---|---|---|---|
| JP | 52-10776 | U | 7/1975 |
| JP | 54-61673 | | 5/1979 |
| JP | 54-61673 | U | 5/1979 |
| JP | 57-101292 | | 6/1982 |
| JP | 1-151073 | | 10/1989 |
| JP | 1-151073 | U | 10/1989 |
| JP | 5-304382 | | 11/1993 |
| JP | 6-216555 | | 8/1994 |
| JP | 06-216555 | A | 8/1994 |
| JP | 6-291481 | | 10/1994 |
| JP | 06-291481 | A | 10/1994 |
| JP | 10-144831 | | 5/1998 |
| JP | 2003-110074 | A | 4/2003 |

OTHER PUBLICATIONS

Japanese Office Action for Japanese Patent Application No. 2004-262592 mailed Aug. 26, 2008 with English Translation.

Japanese Office Action for Japanese Application No. 2004-262592; Date of mailing Mar. 31, 2009; with English translation.

* cited by examiner

HEAT SINK WITH HEAT PIPES AND METHOD FOR MANUFACTURING THE SAME

CROSS-REFERENCE TO RELATED APPLICATIONS

This application is a continuation application of the U.S. patent application Ser. No. 10/936,850 filed Sep. 9, 2004, the contents of which are incorporated by reference herein in their entirety, priority to which is claimed under 35 U.S.C. § 120; U.S. patent application Ser. No. 10/936,850 claims the benefit of the date of the earlier filed provisional application, U.S. Provisional Application No. 60/502,821, filed on Sep. 12, 2003, the contents of which are incorporated by reference herein in its entirety.

FIELD OF THE INVENTION

The present invention relates to a heat sink in which heat pipes and a space (which functions as an air passages) are provided inside of a base portion having a fin portion mounted thereon, and a method for manufacturing the heat sink.

DESCRIPTION OF THE RELATED ART

A method of mounting fins on a base plate (which is a heat-receiving portion) to dissipate the heat of a heat-generating member is in general use as a heat sink for electronic equipment. In a conventional heat sink consisting of a base plate and fins, an extruded material of aluminum has been in use for many years, but copper is now in wide use for the purpose of enhancing the ability of releasing heat.

Copper is excellent in thermal conductivity, but when the base plate of a heat sink is large or when a heat source is arranged close to an end portion of the base plate, the effect of spreading heat is not sufficient. In that case, the base plate is provided with heat pipes or vapor chambers to enhance the heat-spreading effect, whereby the performance to dissipate heat is enhanced.

However, vapor chambers are costly and holes and screw holes for mounting them have to be designed from the beginning, so that design flexibility is reduced. On the other hand, when installing heat pipes, holes or grooves must be formed in the base plate. Thus, machine work is indispensable.

In addition, when the heat spreader is installed, the thickness of the base plate is increased, thus the material cost is increased and the increased weight requires a redesign for the fixing method thereof, or the like.

Accordingly, one of the objects of the present invention is to provide a heat sink that requires a reduced machine work and is light in weight, low in cost, and high in performance.

SUMMARY OF THE INVENTION

The inventors have made various investigations and experiments with respect to the disadvantages of the conventional heat sinks and found the following facts. That is, if a heat pipe is placed between a first plate member and a second plate, a machine work, such as cutting, for mounting heat pipes becomes unnecessary and the fabricating cost is reduced. In addition, since a space is formed around the heat pipe, the weight of the base portion is reduced and therefore a reduction in the weight of the entire heat sink is achieved. Furthermore, since a portion of the base portion near a heat source has an area that can exchange heat with the surrounding air, it has been found that an enhancement in the heat dissipating ability and an increase in the amount of the surrounding air due to a reduction in passage resistance can be expected.

The present invention has been made in view of the above-described facts obtained from investigations and experiments.

The first embodiment of the heat sink of the invention is the heat sink comprising:

a base portion having inside thereof at least one heat pipe, and a space formed around part of a peripheral portion of said heat pipe; and a fin portion thermally connected to said base portion.

In a second embodiment of the heat sink of the invention, said base portion comprises a first plate member thermally connected to a heat source, and a second plate member thermally connected to said fin portion; and said at least one heat pipe is placed between said first plate member and said second plate member and is thermally connected to said first plate member and said second plate member.

In a third embodiment of the heat sink of the invention, said first plate member comprises a U-shaped plate member including side wall portions and a bottom surface portion; said second plate member comprises a flat plate member being a top surface portion; and said base portion comprises said top surface portion, said side wall portions and said bottom surface portion.

In a fourth embodiment of the heat sink of the invention, said first plate member comprises a flat plate member being a bottom surface portion; said second plate member comprises a U-shaped plate member including side wall portions and a top surface portion; and said base portion comprises said top surface portion, said side wall portions and said bottom surface portion.

In a fifth embodiment of the heat sink of the invention, said at least one heat pipe comprises a flattened heat pipe, a top surface portion of said flattened heat pipe being thermally connected to said second plate member, and a bottom surface portion of said flattened heat pipe being thermally connected to said first plate member.

In a sixth embodiment of the heat sink of the invention, said space comprises spaces defined by side surfaces of said heat pipe, said side walls portions, said top surface portion and said bottom surface portion of said base portion.

In a seventh embodiment of the heat sink of the invention, said space comprises spaces between adjacent heat pipes and spaces defined by side surfaces of said heat pipe, said side wall portions, said top surface portion, and said bottom surface portion of said base portion.

In an eighth embodiment of the heat sink of the invention, said heat pipe is arranged so as to extend along a longitudinal direction of said fin portion.

A ninth embodiment of the heat sink of the invention comprises, a base portion having inside thereof at least one heat pipe, a space formed around part of a peripheral portion of said heat pipe, and a metal block; and a fin portion thermally connected to said base portion.

In a tenth embodiment of the heat sink of the invention, said base portion comprises a first plate member thermally connected to a heat source, and a second plate member thermally connected to said fin portion; and said at least one heat pipe and said metal block are placed between said first plate member and said second plate member, and are thermally connected to said first plate member and said second plate member.

In an eleventh embodiment of the heat sink of the invention, said first plate member comprises a U-shaped plate member including side wall portions and a bottom surface portion; said second plate comprises a flat plate member being a top surface portion; and said base portion comprises said top surface portion, said side wall portions, and said bottom surface portion.

In a twelfth embodiment of the heat sink of the invention, said first plate member comprises a flat plate member being a bottom surface portion; said second plate member comprises a U-shaped plate member including side wall portions and a top surface portion; and said base portion comprises said top surface portion, said side wall portions and said bottom surface portion.

In a thirteenth embodiment of the heat sink of the invention, said metal block is formed integrally with said first plate member.

In a fourteenth embodiment of the heat sink of the invention, said metal block is arranged to extend across the entire length of said base portion.

In a fifteenth embodiment of the heat sink of the invention, said metal block is arranged only in a portion of said first plate member which is connected to said heat source.

In a sixteenth embodiment of the heat sink of the invention, said metal block is arranged between said heat pipes and is connected to part of each heat pipe.

In a seventeenth embodiment of the heat sink of the invention, a heat sink to be used with a heat source can include a base portion and a fin portion. The base portion can include a plurality of heat pipes and a space formed at least partially between adjacent heat pipes. The base portion can also include a first plate thermally connected to the heat source and a second plate thermally connected to the fin portion. The plurality of heat pipes contacts the first plate and the second plate. The plurality of heat pipes can also include a first portion that is closer than a second portion to the heat source. Additionally, a distance between adjacent heat pipes is smaller at the first portion than at the second portion.

A first embodiment of a method for manufacturing a heat sink of the invention comprises the steps of:

preparing a first plate member comprising a U-shaped plate member including side wall portions and a bottom surface portion, which is connected to a heat source, and joining at least one heat pipe to the bottom surface portion of said U-shaped plate member;

preparing a second plate member comprising a flat plate member, and joining a fin portion to one surface of said flat plate member; and joining said first plate member with said heat pipe and said second plate member with fin portion to fabricate a heat sink comprising a base portion having inside thereof said at least one heat pipe and a space formed around part of a peripheral portion of said heat pipe, and said fin portion thermally connected to said base portion.

In a second embodiment of the method of the invention, a metal block is further joined to said bottom surface portion of said U-shaped plate member.

In a third embodiment of the method of the invention, said base portion and said heat pipe, as well as said base portion and said fin portion, are simultaneously joined with solder.

BRIEF DESCRIPTION OF THE DRAWINGS

The present invention will be described in further detail with reference to the accompanying drawings wherein.

DETAILED DESCRIPTION OF THE INVENTION

A heat sink and a heat-sink fabricating method according to the present invention will hereinafter be described in detail with reference to the drawings.

A first heat sink of the present invention includes a base portion and a fin portion thermally contacted with the base portion. The inside of the base portion has at least one heat pipe, and a space (e.g., an air passage) formed around part of the peripheral portion of the heat pipe. The base portion is made up of a first plate member that is contacted with a heat source, and a second plate member thermally contacted with the fin portion. The aforementioned at least one heat pipe is placed between the first plate member and the second plate member and is thermally contacted with the first plate member and the second plate member.

The first plate member consists of a U-shaped plate having side wall portions and a bottom surface portion formed between the side wall portions. The second plate member consists of a flat plate member having a top surface portion. The base portion is constructed of the top surface portion, the side wall portions, and the bottom surface portion. Note that the second plate member may consist of a U-shaped plate member having side wall portions and a bottom surface portion formed between the side wall portions. Also, the first plate member may consist of a flat plate member having a bottom surface portion. When a heat source is small, or when it is positioned at an end portion of a heat sink, it is necessary to spread heat over the entire heat sink and enhance the heat dissipating efficiency of the fin portion joined to the base portion. Generally, heat pipes or vapor chambers are employed in a heat sink. In the case of heat pipe, the aforementioned conventional base portion is provided with grooves or holes, and heat pipes in the grooves or holes are fixed with solder.

In the heat sink of the present invention, the heat pipe is placed between the first plate member and the second plate member, as described above. Therefore, a machine work, such as cutting, for mounting the heat pipe becomes unnecessary and the fabricating cost is reduced. In addition, since a space is formed around the heat pipe, the weight of the base portion is reduced and therefore a reduction in the weight of the entire heat sink is achieved. Furthermore, since a portion of the base portion near the heat source has an area that can exchange heat with the surrounding air, an enhancement in the heat dissipating ability and an increase in the amount of the surrounding air due to a reduction in passage resistance can be expected.

Figure 1:
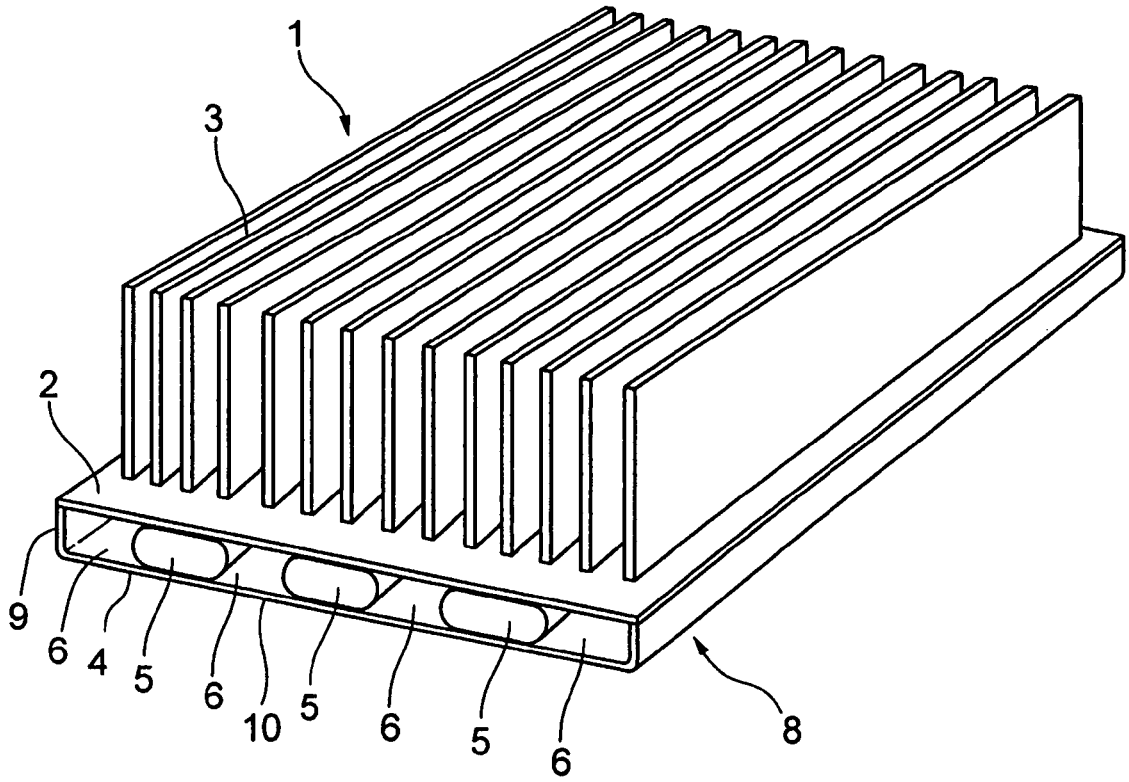
FIG. 1 is a perspective view showing a heat sink with heat pipes constructed in accordance with one preferred form of the present invention.

Referring to FIG. 1, there is shown a heat sink constructed in accordance with one preferred form of the present invention. As shown in the figure, the inside of a base portion 8 has at least one heat pipe 5, and air passages 6 formed around part of the peripheral portion of the heat pipe 5. The base portion 8 is thermally contacted with a fin portion 3. This base portion 8 is constructed of a first plate member 4 that is thermally contacted with a heat source (not shown), and a second plate member 2 thermally contacted with the fin portion 3. At least one heat pipe 5 is placed between the first plate member 4 and the second plate member 2 and is thermally contacted with the first plate member and the second plate member.

The first plate member 4 consists of a U-shaped plate member having side wall portions 9 and a bottom surface portion 10 formed between the side wall portions 9. The second plate member 2 consists of a flat plate member having a top surface portion 2. Thus, the base portion 8 consists of the top surface portion 2, side wall portions 9, and bottom surface portion 10.

The heat pipe 5 is formed by compressing a round type heat pipe to be a flat heat pipe (hereinafter referred to as a "flattened heat pipe", whereby the contact surface between the top surface of the heat pipe and the second plate member 2 and the contact surface between the bottom surface of the heat pipe and the first plate members 4 are made larger. In FIG. 1, three flattened heat pipes 5 are arranged within the base portion 8. Spaces as air passages 6 are provided in a portion defined by the top surface portion, the bottom surface portion, the side wall portion 9 of the first plate member 4 and the heat pipe 5, and in a portion defined by the top surface portion, the bottom surface portion, adjacent heat pipes 5, respectively. The air passage 6 extends across the entire length of the base portion 8 along the longitudinal direction of the fin portion 3. When performing forced-air cooling with a fan, etc., the surrounding air flows through not only the spaces between the fins of the fin portion 3 but also the air passages 6, so the heat dissipating efficiency is enhanced.

As set forth above, at least one heat pipe 5 is constructed of a flattened heat pipe. The top surface portion of the flattened heat pipe thermally contacts the second plate member 2, while the bottom surface portion thermally contacts the first plate member 4.

By adjusting the thickness of the heat pipe 5 and the thickness of the first and second plate members 4 and 2, the base portion 8 can be made thinner.

The fin portion 3 may be joined to one surface of the base portion 8 with solder, etc. The fin portion 3 may also be formed integrally with the base portion 8 as one unit. Furthermore, both sides of each fin which is inserted in the groove formed in the base portion 8 may be mechanically crimped and fixed to the base portion.

Figure 2:
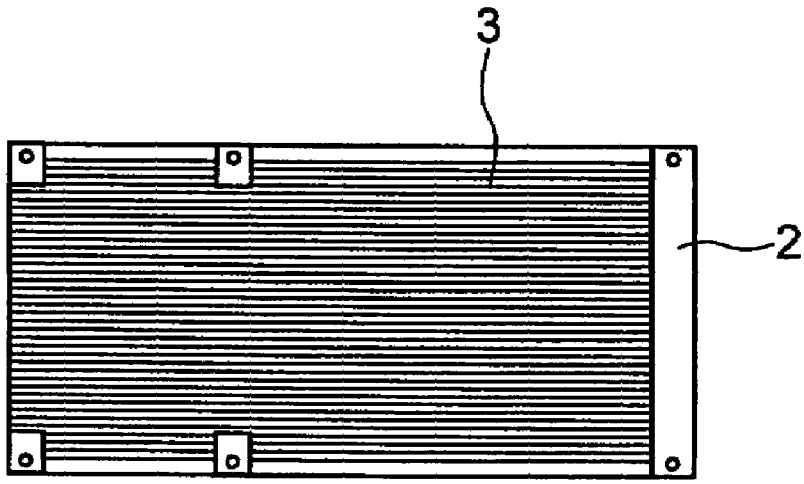
FIG. 2 is a plan view of the heat sink shown in FIG. 1.

FIG. 2 shows a plan view of the heat sink 1 of the present invention. As shown in the figure, the fin portion 3 is formed on one surface of the base portion 8. The fin pitch of the fin portion 3 is made small in order to enhance the effect of releasing heat. Although not shown, a heat source is arranged on the left end portion of the heat sink shown in FIG. 2. The first plate member 4 on which a heat source is arranged is thermally contacted with the heat pipes 5, so heat is transferred along the longitudinal direction of the base portion 8 by the heat pipes 5 and is dissipated through the fin portion 3 joined to the second plate member 2. As set forth above, heat from a heat source arranged on the bottom surface of the first plate member 4 is uniformly spread over the entire base portion 8 by the heat pipes 5 and is then dissipated from the fin portion 3 through the surrounding air.

As shown in FIG. 2, fins are cut out at positions where the fin portion 3 is fixed to the heat sink 1, and fixing members are installed. The heat sink 1 of the present invention is capable of significantly enhancing the heat dissipating efficiency when a heat source is arranged on one end portion of the base portion 8.

Figure 3:
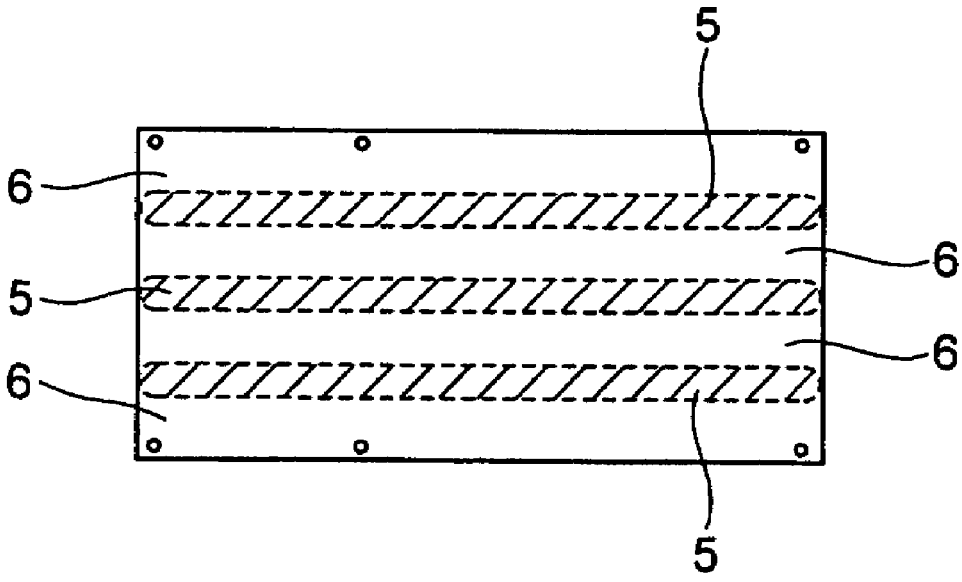
FIG. 3 is a diagram used to explain the heat pipes arranged within the base portion of the heat sink shown in FIG. 1.

FIG. 3 is a diagram used to explain the heat pipes 5 arranged within the base portion of the heat sink. As shown in the figure, the inside of the base portion has at least one flattened heat pipe 5. In the example shown in FIG. 3, three heat pipes 5 are arranged within the base portion. That is, the flattened heat pipes 5 are placed between the bottom surface portion of the U-shaped first plate member (where a heat source is placed) and the top surface portion of the second plate member (joined with the fin portion) and are contacted with the bottom surface portion and top surface portion of the first and second plate members through the flattened wide top and bottom surface portions of the heat pipes 5. Although the arrangement of the heat pipes 5 is determined in dependence on the size and position of a heat source, they are arranged across the entire length of the base portion 8 along the longitudinal direction of the base portion 8. Note that the heat pipes 5 do not always need to be arranged across the entire length of the base portion 8. They may be arranged across approximately the entire length, or across a longitudinal length that can obtain the effect of spreading heat over the entire base portion.

Between the side wall portion of the first plate member and a side surface of the heat pipe 5 and between adjacent heat pipes 5, there are provided spaces for air passages 6. By installing a fan for forced-air cooling at one end portion of the base portion, the surrounding air is forcibly passed through the air passages 6, so that the heat dissipating efficiency is increased.

The heat sink with heat pipes of the present invention is fabricated as follows:

That is, a U-shaped plate member, which is contacted with a heat source, equipped with side wall portions and a bottom surface portion is prepared and then a first plate member is prepared by joining at least one heat pipe to the bottom surface portion of the U-shaped plate member. Next, a flat plate member is prepared and a second plate member is prepared by joining a heat dissipating fin portion to one surface of the flat plate member. And the first plate member and the second plate member are joined together to fabricate a heat sink, which includes a base portion having in an inside thereof at least one heat pipe and an air passage formed around part of the peripheral portion of the heat pipe, and a fin portion thermally contacted with the base portion. The fabrication method will be described along with the heat sink of the present invention.

Figure 4:
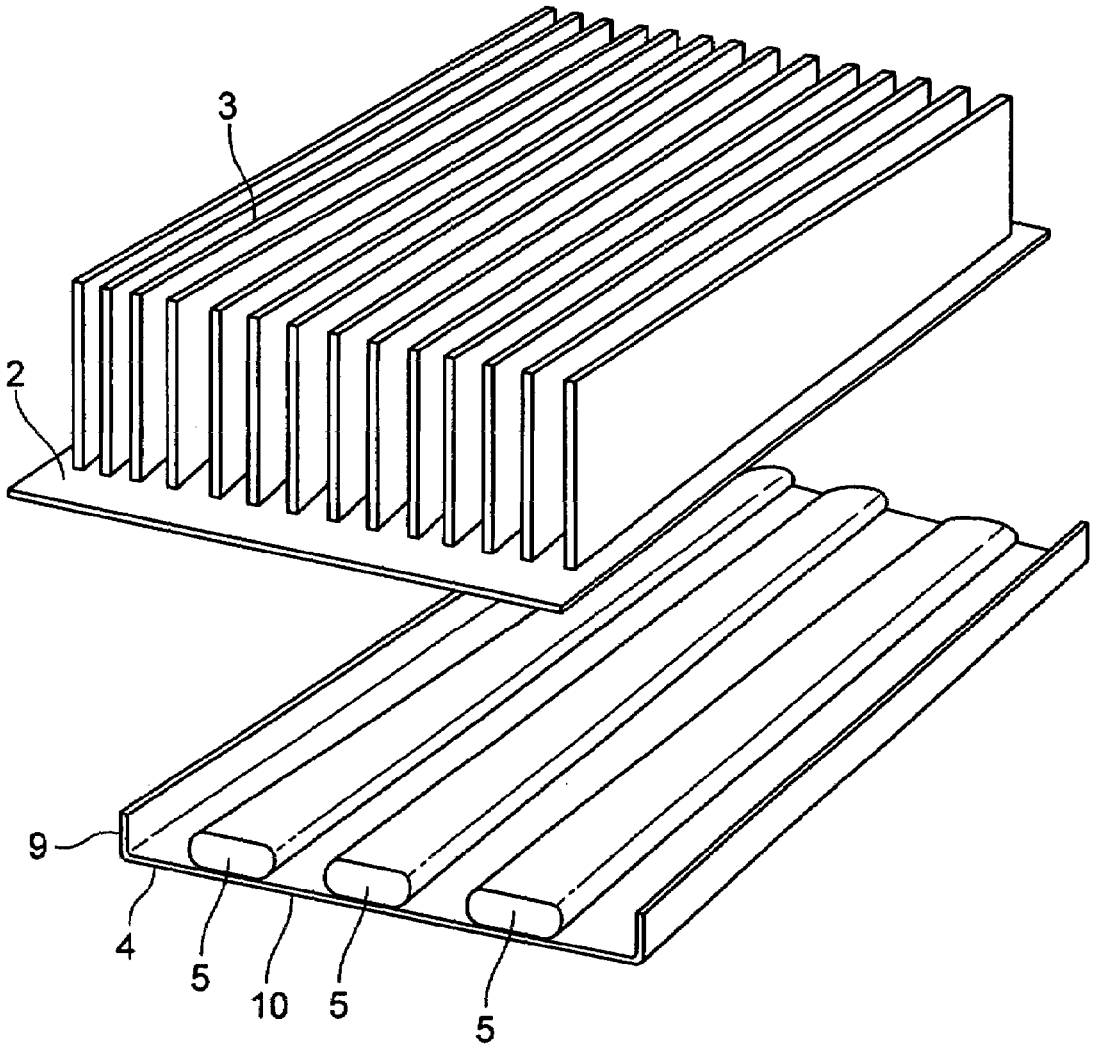
FIG. 4 is an exploded perspective view of the second plate joined with the fin portion and the first plate member joined with the heat pipes, constituting the heat sink shown in FIG. 1.

FIG. 4 shows the second plate member 2 joined with the fin portion 3 and the first plate member 4 joined with the heat pipes 5, constituting the heat sink 1 of the present invention.

As shown in the upper portion of FIG. 4, a flat plate member is first prepared. Then, the second plate member 2 is prepared by joining the heat dissipating fin portion 3 on one surface of the flat plate member. Next, as shown in the lower portion of FIG. 4, a U-shaped plate member, which is contacted with a heat source, equipped with side wall portions 9 and a bottom surface portion 10 is prepared and the first plate member 4 is prepared by joining heat pipes 5 to the bottom surface portion of the U-shaped plate member.

Next, if the first plate member 4 joined with the heat pipes 5 and the second plate member 2 joined with the fin portion 3, thus prepared, are joined together, a heat sink is fabricated which consists of a base portion having in the inside at least one heat pipe and air passages formed around part of the peripheral portion of the heat pipe, and a fin portion thermally contacted with the base portion.

As described above, in the heat-sink fabricating method of the present invention, the heat pipes 5 are placed between the first and second plate members 4 and 2 and are thermally contacted with them through wide areas. Therefore, grooves or holes for mounting heat pipes are not needed, as are needed in prior art. Thus, the fabricating cost can be reduced and the heat sink 1 can be easily fabricated.

Figure 5:
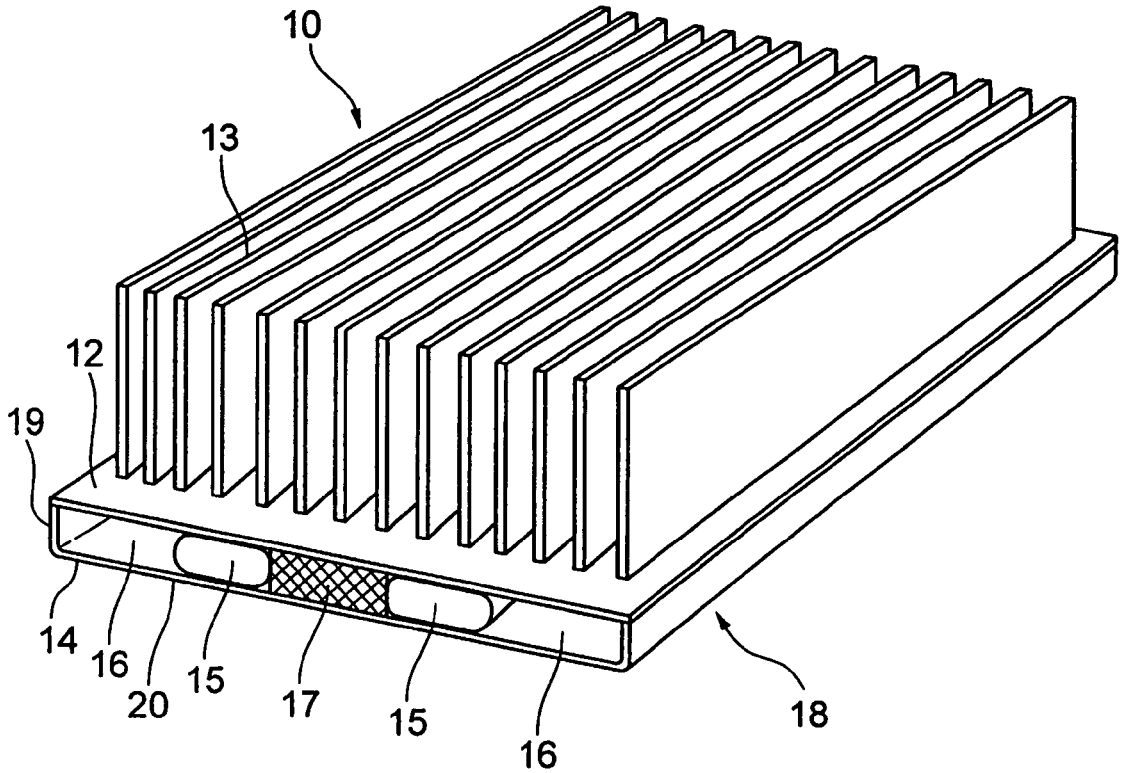
FIG. 5 is a perspective view showing a heat sink with heat pipes constructed in accordance with another preferred form of the present invention.

Referring to FIG. 5, there is shown a second heat sink constructed in accordance with a second preferred form of the present invention.

The second heat sink of the present invention includes a base portion, and a fin portion thermally contacted with the base portion. The inside of the base portion has at least one heat pipe, air passages formed around part of the peripheral portion of the heat pipe, and a metal block. The base portion consists of a first plate member that is contacted with a heat source, and a second plate member thermally contacted with the fin portion. At least one heat pipe and the metal block are placed between the first and second plate members and are thermally contacted with them.

As shown in FIG. 5, the inside of a base portion 18 has at least one heat pipe 15, air passages 26 formed around part of the peripheral portion of the heat pipe 15, and a metal block 17. The top surface 12 of the base portion 18 is thermally contacted with a fin portion 13. The base portion 18 consists of a first plate member 14 that is contacted with a heat source, and a second plate member 12 thermally contacted with the fin portion 13. At least one heat pipe 15 and metal block 17 are placed between the first and second plate members 14 and 12 and are thermally contacted with them.

The first plate member 14 is constructed of a U-shaped plate member having side wall portions 19 and a bottom surface portion 20 formed between the side wall portions 19. The second plate member 12 is constructed of a flat plate member having a top surface portion 12. Thus, the base portion 18 is made up of the top surface portion 12, side wall portions 19, and bottom surface portion 20.

In the heat sink 10 shown in FIG. 5, the metal block 17 is arranged at approximately the central portion of the first plate member 14, and the flattened heat pipes 15 are arranged on both sides of the metal block 17. Between the side wall portion 19 of the first plate member 14 and the heat pipe 15, there is formed an air passage 16.

Figure 6:
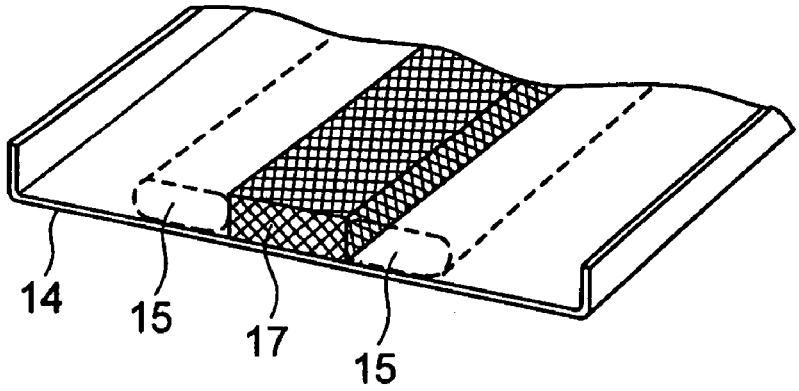
FIG. 6 is a part-perspective view used to explain the positions where the metal block and the heat pipes are joined to the first plate member.

FIG. 6 shows how the metal block and the heat pipes are arranged on the first plate member. As shown in the figure, the rectangular metal block 17 is arranged at approximately the central portion of the bottom surface portion of the first plate member 14. As shown by a dotted line, the flattened heat pipes 15 contact the metal block 17 and are provided on both sides of the metal block 17. The positions of the metal block 17 and heat pipes 15 are not limited to those shown in FIG. 6. In dependence on the size and position of a heat source, the positions of the metal block 17 and heat pipes 15 may be changed in order to enhance the heat dissipating efficiency.

The metal block 17 is able to prevent the heat pipes 15 from drying out when the calorific value of a heat source is particularly great. By contacting the heat pipe 15 with the first plate member 14 (which is contacted with a heat source) and the metal block 17, heat is absorbed by the wide area of the heat pipe 15 through the first plate member 14 and the side wall surface of metal block 17, and a large amount of heat is transferred to the other end of the heat pipe 15 by the phase change of the working fluid between the vapor phase and the fluid phase.

Figure 7:
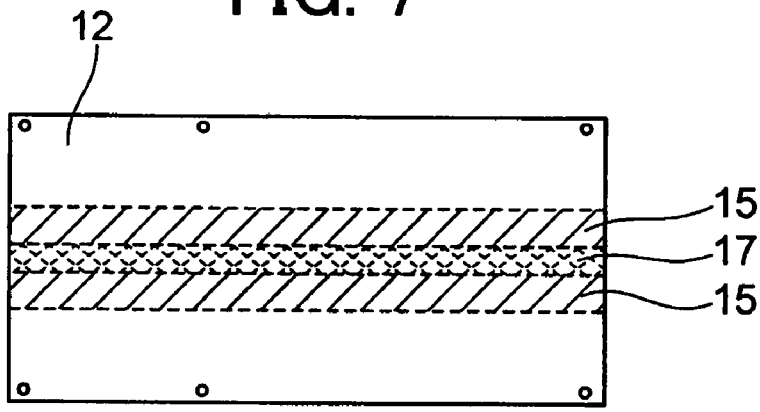
FIG. 7 is a plan view used to explain the metal block and heat pipes arranged within the base portion.

FIG. 7 shows how the metal block 17 and heat pipes 15 are arranged within the base portion 18. As shown in the figure, at least one flattened heat pipe 15 and metal block 17 are arranged in the inside of the base portion 18. In the example of FIG. 7, the metal block 17 is arranged at the central portion of the inside of the base portion 18, and the heat pipes 15 are arranged both sides of the metal block 17. That is, the metal block 17 and flattened heat pipes 15 are placed between the bottom surface portion 20 of the U-shaped first plate member 14 (which is contacted by a heat source) and the top surface portion of the second plate member 12 (joined with the fin portion) and are thermally contacted with the first and second plate members 14 and 12 through the wide areas thereof. In this way, the metal block 17 and flattened heat pipes 15 are arranged in the inside of the base portion 18.

Figure 11:
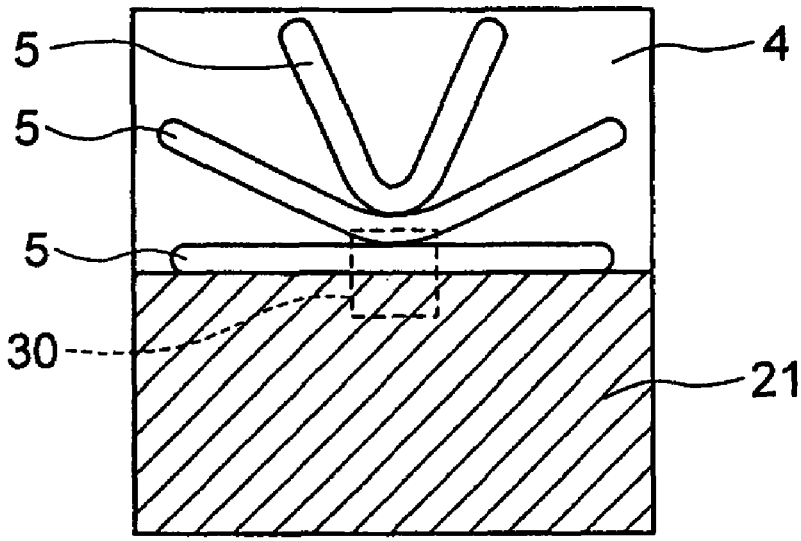
FIG. 11 is a plan view showing another arrangement of a copper solid and heat pipes.

Although the heat pipe 15 and metal block 17 are arranged in dependence on the size and position of a heat source, they are arranged across the entire length of the base portion 18 along the longitudinal direction of the base portion 18. In addition, between the side wall portion of the first plate member 14 and the side surface of the heat pipe 15, there is provided a space for air passage. By installing a fan for forced-air cooling at one end portion of the base portion 18, the surrounding air can be forcibly passed through the air passages 16, so that the heat dissipating efficiency is enhanced. base portion, arranged in parallel with the copper solid, which has spaces formed around a heat pipe. As shown in FIG. 11, the copper solid 21 is formed integrally with a first plate member 4. A heat source 30 is arranged so it thermally contacts the copper solid 21 and the first plate member 4. That is, a portion of the copper solid 21 is arranged so it thermally contacts the heat source 30. Similarly, some of three heat pipes 3 are arranged so they thermally contact the heat source 30 through the first plate member 4. In this example, the three heat pipes 5 are arranged close to each other at the central portion, and the spacing between the heat pipes 5 is gradually increased from the central portion toward both end portions of the first plate member 4.

Figure 12:
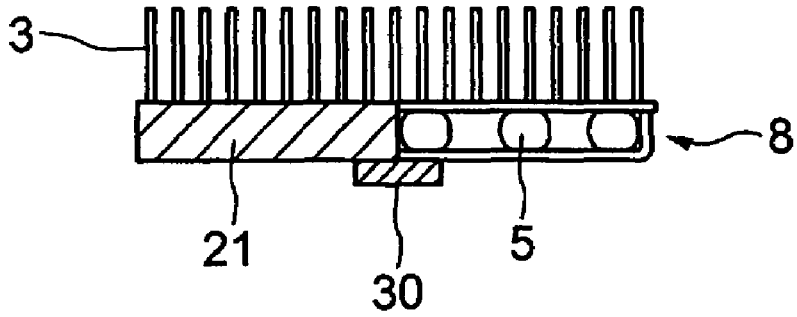
FIG. 12 is a side view of a heat sink equipped with a copper solid and heat pipes arranged as shown in FIG. 11.

FIG. 12 shows a heat sink having a copper solid and heat pipes arranged as shown in FIG. 11. In this example, the copper solid 21 is formed integrally with the base portion 8. The inside of the base portion 8 has three heat pipes 5 arranged as described above. A heat source 30 contacts a portion of the copper solid 21 and a portion of the base portion 8. A fin portion 3 is mounted on the top surface of the copper solid 21 and the top surface of a second plate member. As with the above-described examples, spaces (e.g., air passages) are formed around the peripheral portion of the heat pipe 5.

The heat pipe 5 is equipped with a sealed metal tube containing a small amount of working fluid. Heat is transferred by the phase change (between vaporization of the working fluid and condensation of the vapor) and movement of the working fluid. Part of the heat from the heat source 30 is transferred through the container constituting the heat pipe 5, but most of the heat is transferred by the phase change and movement of the working fluid.

The above-described metal block 17 may be formed integrally with the first plate member 14 instead of being joined to the first plate member 14. In the above-described heat sinks 1 and 10 of the present invention, while the metal block 17 is arranged across the entire length of the base portion 18, the metal block 17 may be arranged only in a portion of the first plate member 14 which is contacted with a heat source.

Figure 8:
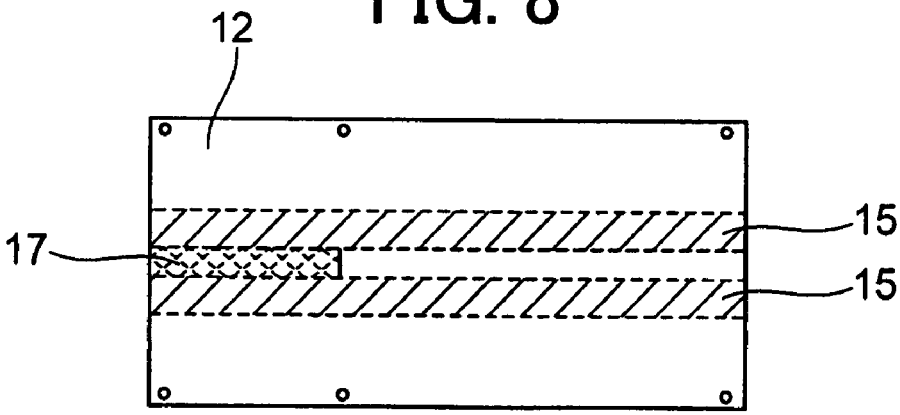
FIG. 8 is a plan view used to explain a metal block arranged only in a portion of the first plate member that is contacted with a heat source heat.

FIG. 8 shows the case where a metal block is arranged only in a portion of the first plate member that is contacted with a heat source heat. As shown in the figure, the metal block 17 is arranged only in a portion of the first plate member 12 that is contacted with a heat source heat. The heat pipes 15 are provided along the longitudinal direction across the entire length of the base portion 18.

Figure 9:
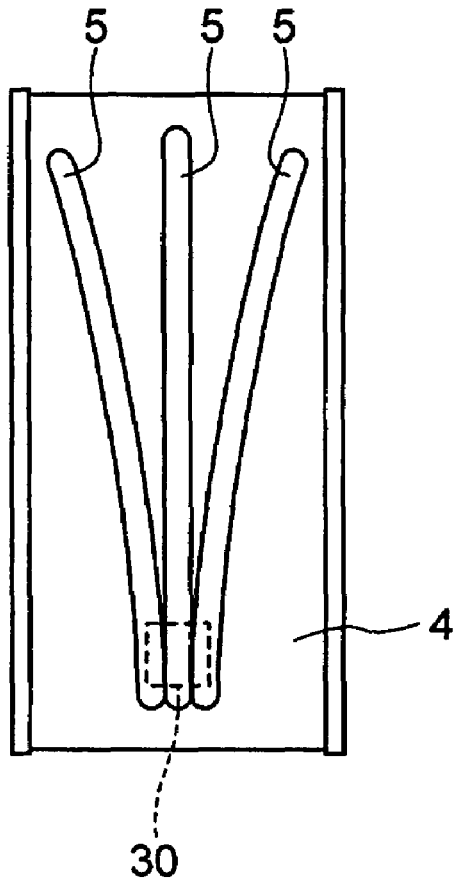
FIG. 9 is a plan view showing another arrangement of heat pipes.

FIG. 9 shows another arrangement of heat pipes. As shown in the figure, three heat pipes 5 are arranged close to each other at one end of a first plate member 4 where a heat source 30 is arranged. The spacing between the heat pipes 5 becomes wider toward the other end of the first plate member 4. As with the aforementioned examples, spaces (e.g., air passages) are formed around the peripheral portion of the heat pipe 5.

Figure 10:
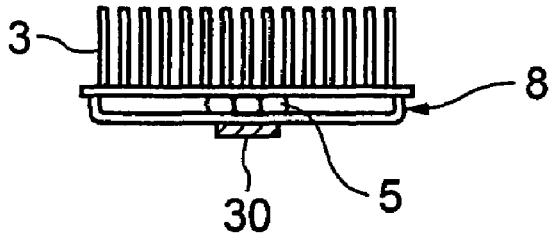
FIG. 10 is a side view of a heat sink equipped with heat pipes arranged as shown in FIG. 9.

FIG. 10 shows a heat sink equipped with heat pipes arranged as shown in FIG. 9. As shown in FIG. 10, three heat pipes 5 are arranged close to each other at one end of a first plate member 4 where a heat source 30 is arranged. A fin portion 3 is mounted on the top surface of a second plate member.

FIG. 11 shows another arrangement of a copper solid and heat pipes. In this example, a heat sink includes a copper solid and a More specifically, heat from the heat source 30 (e.g., electronic equipment) is absorbed at one end of the heat pipe 5 by vaporization of the working fluid and is dissipated at the other end by condensation of the vapor. And the working fluid returns to the one end of the heat pipe. Thus, heat transfer is performed by the phase change and movement of the working fluid.

The working fluid within the heat pipe 5 normally uses water, an aqueous solution, alcohol, an organic solvent, etc. There are cases where mercury is used in a special application. As previously mentioned, the heat pipe makes use of the phase change of the working fluid, so the heat pipe is made so that gases, etc., are not mixed with the working fluid. Such a mixture is normally the surrounding air that enters during the making of the heat pipe, carbonic acid gas contained in the working fluid, etc. In addition to a typical round heat pipe, a flat type is also widely used. Heat transferred by heat pipes may be forcibly cooled by using a fan, etc.

The material of the container of the heat pipe can use a high conductive metal such as copper, aluminum, etc. To form a flattened shape, aluminum is preferred. The wick can use a member of the same material as the container of a flattened heat pipe. The working fluid uses water, alternate chloro fluorocarbons (CFCs), or fluorinated fluid, depending on compatibility with the material of the container of a heat pipe.

The functions of the heat sink of the present invention will hereinafter be described in detail.

A description will be given in the case where a small heat source is arranged at one end of the heat sink. Heat is first transferred from a heat source to the first plate member through a thermal interface (grease or heat-transfer sheet). Heat is diffused in the first plate member to some degree by the heat conduction of the first plate member itself and is transferred to the heat pipes thermally contacted with the first plate member. In the case of a plurality of heat pipes, heat is spread by the spreading effect of the first plate member, and flows in heat pipes without concentrating on one heat pipe. The heat pipes are placed between the first plate member and the second plate member that is provided with fins. Since the heat pipes are installed across approximately the entire length of the first plate member, thermal diffusion is performed so that the second plate member is approximately uniformly heated during the heat transfer from the first plate member to the second plate member.

This thermal diffusion is performed by the heat-transfer characteristic and uniform heating characteristic of heat pipes. If the above-described plates, heat pipes, fins, etc., are joined at a time with solder, the soldering step can be simplified. In ordinary heat sinks, heat is dissipated to environment by convective air, and the surrounding air passes through only the spaces between fines on the other hand, in the heat sink of the present invention, the surrounding air passes through air passages formed around the heat pipes as well as the spaces between fins, so heat exchange is efficiently performed. In addition, since the air passage is enlarged, air resistance is small. Therefore, high performance can be realized with the same fan, and low noise and low power consumption can be realized with the same amount of the surrounding air.

Figure 13:
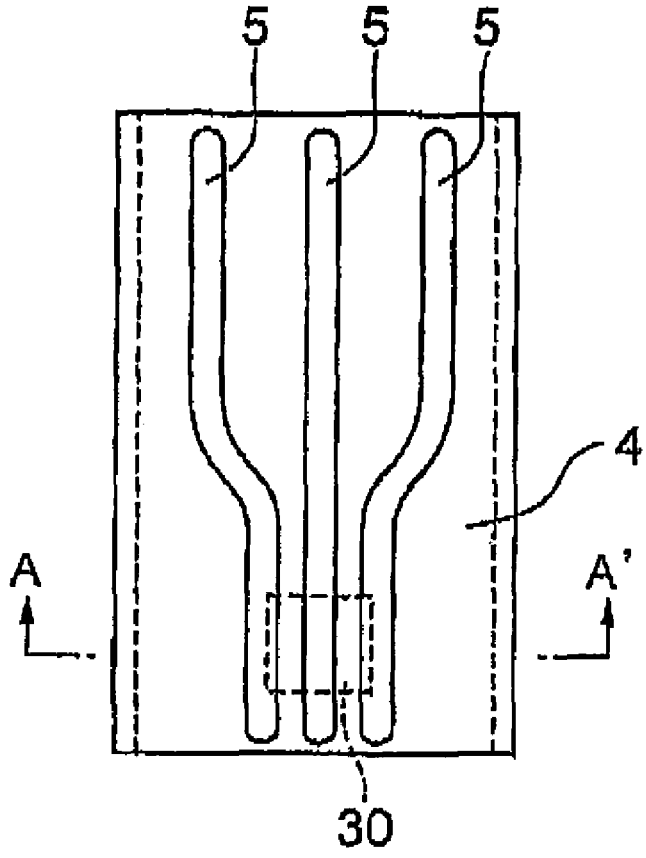
FIG. 13 is a plan view showing a third arrangement of heat pipes.
Figure 14:
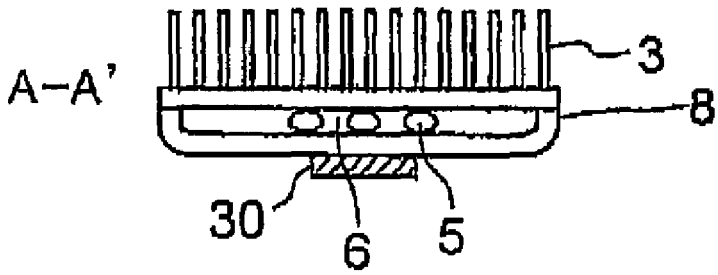
FIG. 14 is a sectional view taken along line A-A' of FIG. 13.

FIG. 13 shows a third arrangement of heat pipes. FIG. 14 is a sectional view taken along line A-A' of FIG. 13. As shown in FIG. 13, at a portion of a first plate member 4 corresponding to a position where a heat source 30 is arranged, three heat pipes 5 are arranged close to each other at a predetermined spacing. That is, as shown in FIG. 14, predetermined air passages 6 are assured between the heat pipes 5. The spacing between the heat pipes 5 is parallel near the heat source 30 and is gradually enlarged toward the other end of the first plate member 4.

In the example shown in FIGS. 13 and 14, spaces (e.g., airpassages) are formed around the heat pipes 5 arranged within the base portion 8. Air passages are also assured around the heat pipes 5 near the heat source 30, and the surrounding air flows in the air passages. Thus, heat from the heat source 30 can be efficiently dissipated. That is, in the case where the surrounding air flows from the wider spacing between the heat pipes 5, the flow of the surrounding air is concentrated near the heat source 30 and therefore greater flow speed is obtained.

Figure 15:
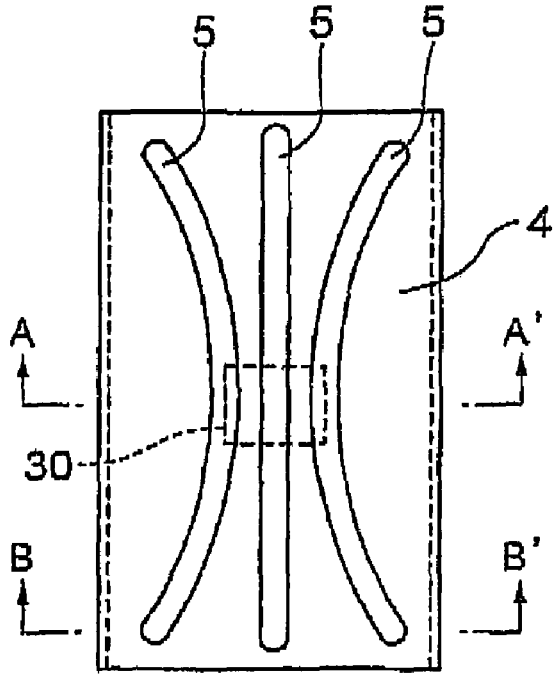
FIG. 15 is a plan view showing a fourth arrangement of heat pipes.
Figure 16:
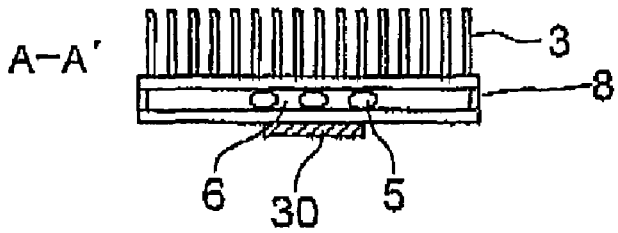
FIG. 16 is a sectional view taken along line A-A' of FIG. 15.
Figure 17:
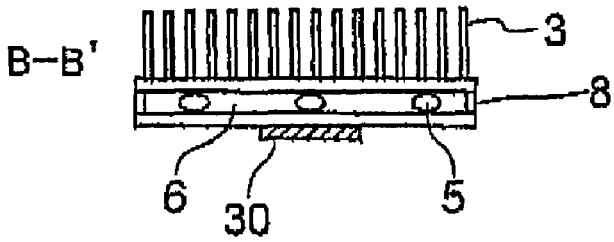
FIG. 17 is a sectional view taken along line B-B' of FIG. 15.

FIG. 15 shows a fourth arrangement of heat pipes. FIG. 16 is a sectional view taken along line A-A' of FIG. 15. FIG. 17 is a sectional view taken along line B-B' of FIG. 15. As shown in these figures, a heat source 30 is arranged at the central portion of a first plate member 4. At a portion of the first plate member 4 corresponding to a position where the heat source 30 is arranged, three heat pipes 5 are arranged close to each other at a predetermined spacing. That is, as shown in FIG. 16, predetermined air passages 6 are ensured between the heat pipes 5. The spacing between the heat pipes 5 is parallel near the heat source 30 and is gradually enlarged toward both ends of the first plate member 4.

As shown in FIG. 17, the air passage between the heat pipes 5 is broader at both ends of the first plate member 4. Since spaces (e.g., air passages) are formed around the heat pipes 5 arranged within the base portion 8, air passages is ensured around the heat pipe 5 near the heat source 30 and the surrounding air flows. Thus, heat from the heat source 30 can be efficiently dissipated. Particularly, the spacing between the heat pipes 5 is gradually enlarged from the central portion of the first plate member 4 toward both ends, so even if the surrounding air flows in any direction, it flows effectively near the heat source 30 and therefore the heat dissipating efficiency can be enhanced. Furthermore, the heat pipes 5 can be approximately radially arranged from the center portion, so the heat dissipating efficiencies of the base portion 8 and fin portion 3 are enhanced.

EMBODIMENT 1

The heat sink 1 with heat pipes 5 of the present invention shown in FIG. 1 was made. In this embodiment, a copper plate of 1.2 mm in thickness was used in the first plate member 4 and a copper plate of 0.8 mm in thickness was used in the second plate member 2. Three flattened heat pipes which are transformed from 6 mm in diameter to 3 mm in thickness were arranged between the first and second plate members. The height was 20 mm in total. The three heat pipes were arranged at equal spaces within the base portion 8. The fin thickness was 0.3 mm.

A heat source is arranged at the center of the short edge of the first plate member and at a position 20 mm away from one end of the long edge. Although one of the three heat pipes was positioned just above the heat source, heat was also distributed to the remaining two heat pipes. Therefore, an increase in the amount of input heat and the heat density, which can cause the dry-out of the heat pipes, could be reduced. In addition, since the heat pipe is extended from one end of the long edge to the other end, the entire base portion 8 can be uniformly heated. Convective air also passes through the air passage formed around the heat pipe arranged within the base portion 8. Therefore, more heat could be efficiently dissipated at a position closer to the heat source. Furthermore, because the area of the air passage is gradually increased, the resistance to the air passage is reduced.

EMBODIMENT 2

The heat sink 10 with heat pipes 15 of the present invention shown in FIG. 5 was made. The construction is nearly the same as the embodiment 1, but the metal block 17 is provided between the first plate member 14 and the second plate member 12. The metal block (or center block) 17 of 10 mm in width is provided at the center portion of the short edge of the first plate member 14 and extends from one end of the long edge to the other end. On both sides of the center block, there are provided two heat pipes. The heat pipe is approximately 15 mm in width.

The position of a heat source is the same as the embodiment 1. In this case, the center block is positioned just above the heat source, and the thermal diffusion effect is further obtained in addition to the thermal diffusion effect of the first plate member of 1.2 mm in thickness. As a result, heat flux is reduced when heat is transferred to the heat pipe, so even when calorific value of the heat source is greater than that of the embodiment 1, there is no possibility that the so-called dry out phenomenon will occur. In addition, the broad heat pipe is great in the amount of heat transfer per pipe, so the heat-transfer ability is great. Although the number of heat pipes is two, this embodiment can cope with a heat source of larger capacity than that in the embodiment 1.

While the present invention has been described with reference to the preferred embodiments thereof, the invention is not to be limited to the details given herein, but may be modified within the scope of the invention hereinafter claimed. For example, the material of each member is not limited to copper, but may be aluminum or plated aluminum. The joining of the fins and the second plate member is not limited to soldering, but they may be mechanically joined. The heat pipe is not limited to a round pipe and a flattened pipe, but may be a heat-transfer element utilizing latent heat of vaporization. The length, diameter, and flatness of the heat pipe and the number of pipes can be freely selected.

The first and second plate members and fin thickness can be freely selected.

As set forth above, the present invention is capable of providing a heat sink that requires a reduced a machine work. The invention is also capable of providing a heat sink that is light in weight, low in cost, and high in performance.

What is claimed is:

1. A heat sink for use with a heat source comprising:

a plurality of heat pipes;

a thermal conductive housing which accommodates the heat pipes therein, the housing having an open end and including a lower plate, an upper plate and an edge wall extending between an edge of the lower plate and an edge of the upper plate in order that an inner height of the housing is defined by a distance between the lower plate and the upper plate; and thermal dissipation fins attached to an outer surface of the upper plate of the housing;

wherein an outer surface of the lower plate is thermally connected to the heat source;

wherein each of said plurality of heat pipes has a first contact surface in surface contact with an inner surface of said lower plate and a second contact surface in surface contact with an inner surface of said upper plate, said first and second contact surfaces each extending along a length of said heat pipes within the housing, a distance between said first contact surface and second contact surface defining a thickness of said plurality of heat pipes said thickness corresponding to the inner height of the housing;

wherein said plurality of heat pipes comprises a first portion and a second portion within the housing, said first portion being positioned closer than said second portion to the heat source;

wherein within the housing, a distance between adjacent heat pipes of said plurality of heat pipes is smaller at said first portion than at said second portion; and whereby within the housing, said first contact surface of said first portion is adapted to operate as an evaporator section which receives heat from the lower plate whereas said second contact surface of said second portion is adapted to operate as a condenser section which releases heat to the upper plate.

2. The heat sink according to claim 1, wherein said first portion of the heat pipes is defined by a central portion of the heat pipes, and said second portion of the heat pipes is defined by ends of the heat pipes.

3. The heat sink according to claim 2 wherein the distance between said adjacent heat pipes is increased in going from said central portion to said ends of the heat pipes.

4. The heat sink according to claim 1, wherein said first portion of the heat pipes is defined by a first end of the heat pipes, and said second portion of the heat pipes is defined by a second end of the heat pipes.

5. The heat sink according to claim 4, wherein the distance between said adjacent heat pipes is increased in going from said first end to said second end of the heat pipes.

6. The heat sink according to claim 2 wherein the heat source is positioned at or near a central portion of said lower plate.

* * * * *